US005161696A

United States Patent [19]

Seider

[11] Patent Number: 5,161,696

[45] Date of Patent: Nov. 10, 1992

[54] METHOD AND APPARATUS FOR SEPARATING SHAPES OF ABRASIVE GRAINS

[75] Inventor: Robert J. Seider, Ransomville, N.Y.

[73] Assignee: Washington Mills Electro Minerals Corp., Niagra Falls, N.Y.

[21] Appl. No.: 688,096

[22] Filed: Apr. 19, 1991

[51] Int. Cl.[5] ..... B03C 7/00

[52] U.S. Cl. ..... 209/127.4; 209/129

[58] Field of Search ..... 209/2, 4, 127.1, 127.3, 209/127.4, 129; 51/309

[56] References Cited

U.S. PATENT DOCUMENTS

| | | | |
|---|---|---|---|
| 813,063 | 2/1906 | Sutton et al. | 209/127.4 |
| 924,032 | 6/1909 | Blake et al. | 209/127.4 X |
| 2,174,681 | 10/1939 | Bartlett | 209/127.4 X |
| 2,217,441 | 10/1940 | Hansen . | |
| 2,217,444 | 10/1940 | Hill | 209/127.4 X |
| 3,256,985 | 6/1966 | Carpenter | 209/129 |
| 3,477,568 | 11/1969 | Madrid | 209/127.3 |
| 3,478,494 | 11/1969 | Lustenader et al. . | |
| 3,625,360 | 12/1971 | Schickel | 209/127.3 |
| 4,247,390 | 1/1981 | Knoll | 209/129 |
| 4,797,201 | 1/1989 | Kuppers et al. | 209/127.4 |
| 4,848,041 | 7/1989 | Kruschke | 51/309 |
| 4,943,368 | 7/1990 | Gilbert et al. | 209/2 |

FOREIGN PATENT DOCUMENTS

| | | | |
|---|---|---|---|
| 1174274 | 7/1964 | Fed. Rep. of Germany | 209/127.4 |
| 3213399 | 10/1983 | Fed. Rep. of Germany | 209/127.4 |
| 0709174 | 1/1980 | U.S.S.R. | 209/127.3 |
| 0784925 | 12/1980 | U.S.S.R. | 209/127.4 |
| 0977038 | 11/1982 | U.S.S.R. | 209/127.4 |

*Primary Examiner*—D. Glenn Dayoan
*Attorney, Agent, or Firm*—Michael L. Dunn

[57] ABSTRACT

A method of electrically separating differing shapes of abrasive grain materials by imposing a high voltage corona induction charge to free-falling abrasive particles, polarization thereof and attraction thereof to a high voltage oppositely charged electrical field is disclosed, along with apparatus by which the method is practiced and the characteristics of shape of the particles of abrasive grain materials so separated.

20 Claims, 2 Drawing Sheets

METHOD AND APPARATUS FOR SEPARATING SHAPES OF ABRASIVE GRAINS

BACKGROUND OF THE INVENTION

1. Field of the Invention

The present invention relates to the classification of abrasive grains into different categories and more specifically the separation of aluminum oxide abrasive grains into two shape categories, those grains which are appropriate for heavy duty bonded abrasives and those grains which are appropriate for both light duty bonded abrasives and coated abrasives.

2. Background of the Invention

A substantial quantity of the abrasive grains used in the world at present are produced from aluminum oxide, more specifically fused alumina which is predominantly made either from a material called corundum, which is a naturally occurring high alumina content material, or from high alumina content bauxite which is melted in an arc furnace. At present, a much larger percentage of the aluminum oxide abrasive grain produced, is derived from the arc melting of bauxite, rather than from corundum, primarily because bauxite is more readily available and less expensive.

The bauxite used is first calcined to drive off associated water of hydration, as well as moisture content. Then it is placed into an electric arc furnace along with a small percentage of metallurgical grade coke (specifically sulfur free) which serves to reduce the bauxite, thus producing brown alumina with an aluminum oxide content in a range of 94.5 to 97.5%, in comparison to the aluminum oxide content of bauxite which is 90% or less. In some cases, depending upon the desired purity of the alumina, iron turnings are also added to the melt which react with the excess oxygen and silicons that are present to form ferrosilica which gathers in the lower portion of the melt.

The arc melting furnace comprises what amounts to a very large caldron capable of holding ten tons or more of material. It is water cooled so that there is always a layer of unmelted bauxite on the inside wall of the furnace. This provides somewhat of an insulating refactory lining for the furnace. A single melting cycle is somewhat extended and can take several days. The molten aluminum oxide is then removed from the furnace and cooled into very large chunks called crude. The crude is then crushed through successive operations to form what is commonly known as grinding grit or grain. The brown alumina crude grinding grit is then subjected to alternative further crushing operations to further reduce it in size and to impose some distinction to the shape of the grains. The various shaped grains are then classified into standard grit sizes, the size classifications which include a range of particles sizes but which average out to about the indicated grit classification size.

For normal commercial purposes, abrasive grits are classified, as mentioned above, by standard grit size. The most frequently found sizes of grits range from about a 12 grit, which is relatively large, down to about a 600 grit which is very fine and is used more for polishing surfaces of materials than for removing any considerable mass of that material.

As stated above, there are two basic classifications of abrasive products which are made using abrasive grains. These are bonded abrasives, which are exemplified by what is well known as a grinding wheel, and coated abrasives, exemplified by what is well known as sand paper. Of course, in addition to these, abrasive grains, by themselves, are used for polishing and finishing purposes and may also be used for force fed abrasive purposes such as sandblasting, rotoblasting, etc.

For use in heavy duty abrasive grinding wheels, e.g., snagging wheels, after arriving at the size of the abrasive grain to be used for that grinding wheel, there is a preference, within that grit size range, for what are known as blocky grains. Blocky grains are those which usually tend to be shaped more like spheres or cubes as distinguished from flat elongated, or needlelike shapes. Blocky grains usually have an aspect ratio of about 2:1 or less. An aspect ratio is the ratio between the longest dimension spanning the two most remote opposed points on any given structure to the shortest dimension spanning the two closest opposed points on that structure. Thus, it might be said that the lower the aspect ratio, the more blocky the grain is considered to be.

The reason for desiring blocky grains in bonded abrasive products, such as heavy duty grinding wheels, is that such grinding wheels are normally subjected to a much higher amount of pressure resulting from applied force in comparison to light duty bonded abrasives or coated abrasives. Thus, the grain in a bonded abrasive product must be able to withstand shattering or crumbling under such relatively heavy force loads. Blockier grains tend to exhibit much higher strength characteristics and are not nearly as prone to shattering as those grains which are classified as sharp grains. Sharp grains, on the other hand, are those which have a relatively high aspect ratio; 3:1, 4:1 or even substantially higher aspect ratios are not uncommon in an analysis of grain shapes which are classified as sharp grains. In other words, the sharp grains are those which are the most elongated. Sharp grains are preferred for some light duty bonded applications, e.g., metal cutting tool grinding wheels, where attributes such as higher cutting rates and cooler cutting are desired. Such applications involve the imposition of substantially lower pressures and force to the grinding wheels. However, an undesirable attribute of grinding wheels containing sharp grit is a relatively high rate of wear. Sharp grit is much more frequently used in coated abrasives wherein the grit particles are glued or bonded to some sort of materials which is flexible, such as paper or cloth.

The primary reason, for selecting sharp grit for coated abrasive products, is that sharp grit particles tend to have considerably higher cutting rates at considerably lower applied forces in comparison to blocky grit. This is not to say that it is not useful, in some applications, to have some content of blocky grit among a mixture of abrasive grits used for coated abrasives. However, it should be understood that, predominantly, there would be a substantially higher content of sharp grit particles, in comparison to the content of blocky grit particles, in the selection of a grit size array which is preferred especially for coated abrasive production.

U.S. Pat. No 2,217,441 discusses the mixtures that might be appropriate in respect to the amounts of sharp grits mixed with blocky grits use in coated abrasives. This reference also describes in some detail a method of uniformly applying mixtures of the different sizes of grits within a given grit size classification to a backing material by use of electrostatic classification and separation in respect to distributing the grit size range array onto the backing material.

As mentioned previously, the crushed crude fused aluminum oxide (brown alumina) is first classified into grouped grit sizes commonly called splits. For example, a run of material from a roll crusher may be grouped into splits designated as 12/20, 24/36, 46/80 and 90/F. The 12/20 split, for example, would contain 12, 14, 16 and 20 grit size material and the 24/36 split would contain 24, 30 and 36 grit size material; the 90/F split would contain 90 and finer size grit material.

In crushing the crude aluminum oxide, from the large chunks produced by the arc furnace to the individual grit sizes, different types of crushing produce somewhat different shaped particles. For example, roll crushing tends to produce predominantly more sharp grains while impact crushing produces predominantly more intermediate to blocky shaped grains. Depending on the grit size classification of material ultimately desired, additional passes of the material through either the roll crushing process or the impact crushing process may be used to produce a greater predominance of splits of smaller (finer) grit size material. However, increasing the number of passes through either the roll crushing or impact crushing process also increases the predominance of blocky grit. When it is desired, for example, to produce blocky grit, the splits which have been size classified, i.e., that material which has been graded into a particular split size, is frequently subjected to yet another shaping operation in the form of a hammermill which tends to increase the predominance of blocky grit and produces a relatively higher percentage of blocky grit particles within the mixture, albeit a smaller grit size classification.

The roll crushing process tends to produce material which has a higher percentage of sharp grit, i.e., grit of a given size classification (split or grit size) which has a lower average bulk density and a broader range of bulk density. Roll crushing, however, is a significantly more expensive primary crushing process, and the abrasive industry, in the recent past, has increasing relied more on lower operating cost impact mills as the primary crushing means. The result is that the sharp abrasive grit available today has a higher bulk density range than that commonly available in the past, both because the sharp grit is not as sharp, on average, and because there is a somewhat higher percentage of "intermediate" grit included with the material classified as "sharp". As might be expected, this has produced an increasing degree of consternation in the customers, the manufacturers of light duty bonded products and, especially, the manufacturers of coated products.

In the past, a Sutton steel air table was used to separate or remove either distinctively blocky or distinctively sharp shaped particles from a main stream of abrasive particles and, thereby, alter the particle shape content and shape range of the grit product. The Sutton steel air table comprises an incline table which is attached to a rather strong vibration mechanism which shakes the table while forcing air through perforations in the table to slightly suspend the particles. This device is quite costly and requires a relatively high amount of energy in that the shaking operation is performed, for example, by a ten horse power or larger motor. In addition, the capacity is considered low in that it is limited to, for example, about 800 lbs./hour of 36 grit material. In addition, the Sutton-Steel air table is subject to rather frequent and high cost maintenance due to the basic conceptual design, i.e. that it is constantly shaking; the components of this equipment are considered high wear items. Of course, the cost of operation is commensurately high. There is a need for a considerably simpler type of operation, which is lower in cost, which can separate predominantly bulky abrasive grains from predominantly sharp abrasive grains.

Because it is impractical to inspect grains visually to make a determination whether or not, grain by grain, there is a predominance of sharp grains, another measure is used to classify grains as either blocky or sharp. This classification, as mentioned previously, is by bulk density or the weighted average number of grams per cubic centimeter of any given quantity of grains. For example, the production of a 36 grit grinding wheel must follow specifications; such specifications usually call for a grit which has a bulk density of between 1.85 and 1.92 g/cc. While a coated abrasive, for instance a sandpaper or a cloth abrasive, which uses the same 36 grit abrasive material will normally have a specification that calls for a bulk density of between 1.73 and 1.82 g/cc.

The blocky grit used for grinding wheels is not entirely blocky grit as mentioned before. Rather it contains 20 to 30% of sharp particles. On the other hand, the sharp grit used for coated abrasives may contain as much as 30 to 40% of blocky particles. There is a higher percentage of blocky particles in predominantly sharp grit than there are sharp particles in predominantly blocky grit. The blocky grits are produced via one or more passes through a hammermill, and only a small percentage of the sharp particles escape unbroken. Sharp grits, on the other hand, are produced by roll crushing. However, with each pass through the roll crusher, the percentage of blocky particles increases.

With extensive re-rolling, through a roll crusher, it is difficult to produce a low bulk density grit material. For example, fine (small sized) sharp grit material is readily produced as a by-product when there is a significant demand for coarser grits as only one or two passes through the rolls are required to satisfy the size range specification requirements for coarse grit. On the other hand, if a lower percentage of coarse grit or a higher percentage of fine grit are required, additional roll crushing passes are required, resulting in a progressive increase in the bulk density of the grit material with each successive pass.

To explore further the bulk density relationship in regard to grain type. A standard abrasive grit specification grain number 36 G52E was separated on a Jeffrey Table which was divided into 12 compartments to determine the shape components of the grains. The overall bulk density of the 36 G52E grit which was studied was 1.78 g/cc. After the grit was classified into the 12 different shaped components, it was grouped and various of those groupings were tested to determine the metal cut rate, or amount of metal removed, by each shape component of that grain. Table 1, following, indicates the results:

TABLE 1

| Jeffrey Table Compartment | Weight Percent | Bulk Density | Weighted Average Bulk Density | Grams of Cut Metal |
|---|---|---|---|---|
| 1 | 4.5 | 1.94 | 1.93 | 62 |
| 2 | 1.7 | 1.93 | | |
| 3 | 1.8 | 1.93 | | |
| 4 | 2.1 | 1.92 | | |
| 5 | 2.8 | 1.92 | 1.90 | 74 |
| 6 | 4.8 | 1.91 | | |
| 7 | 6.6 | 1.89 | | |

TABLE 1-continued

| Jeffrey Table Compartment | Weight Percent | Bulk Density | Weighted Average Bulk Density | Grams of Cut Metal |
|---|---|---|---|---|
| 8 | 12.7 | 1.87 | 1.87 | |
| 9 | 18.3 | 1.83 | 1.83 | 87 |
| 10 | 24.3 | 1.75 | 1.75 | |
| 11 | 18.9 | 1.63 | 1.62 | 109 |
| 12 | 1.5 | 1.43 | | |

It will be noted from reviewing Table 1 that those shapes from compartments 1–4 on the Jeffrey Table showed a bulk density ranging from 1.92 to 1.94 g/cc with a weighted average of 1.93 g/cc. These are the blockiest grit particles. The second grouping was removed from compartments 5, 6 and 7 having a bulk density range between 1.89 to 1.92 g/cc and a weighted average bulk density of 1.90 g/cc. Compartment 8 is the third grouping with a bulk density of 1.87 g/cc; Compartment 9 is the fourth grouping at 1.83 g/cc bulk density; Compartment 10 is the fifth grouping at a bulk density of 1.75 g/cc; and Compartments 11 and 12 are the sixth grouping with an average weighted bulk density of 1.62 g/cc and a range of bulk density of 1.43 to 1.63 g/cc.

Four of the groupings from Table 1 were mounted onto four different coated abrasive discs and tested for metal removal at a given standard amount of pressure for a standard period of time. The values shown, of grams of metal removed, are of course relative. Group four, the last group on Table 1, being the sharpest grit particles, resulted in a 76% greater amount of metal removed than the blocky grit particles of group one. Thus, it can be said that the sharper grits removed significantly more metal than the blockier grits in coated abrasive discs.

In the manufacture of coated abrasives, generally the backing material, e.g., paper or cloth, is normally coated with some type of adhesive and the abrasive grits are projected onto the surface using electrostatic energy. Those grits that do not project remain in the feed reservoir. A test was conducted to determine the relative projectability of blocky grits in relation to the projectability of sharp grits. The results of this test show that the projectability of blocky grits are relatively less than the projectability of the sharp grits. Table 2 follows and the same grade and specification of grit particles as those used in the above Table 1 test, standard grit specification number 36 G52E, were used.

TABLE 2

| Jeffrey Table Compartment | Weight Percent | Bulk Density | Weighted Average Bulk Density | Project-ability |
|---|---|---|---|---|
| 1 | 8.6 | 2.01 | 2.01 | 2.5 |
| 2 | 1.4 | 1.98 | 1.97 | 2.9 |
| 3 | 1.4 | 1.98 | | |
| 4 | 2.2 | 1.97 | | |
| 5 | 3.8 | 1.96 | | |
| 6 | 7.0 | 1.94 | 1.92 | 3.6 |
| 7 | 9.1 | 1.91 | | |
| 8 | 12.6 | 1.88 | 1.85 | 5.0 |
| 9 | 15.8 | 1.82 | | |
| 10 | 15.9 | 1.78 | 1.78 | 7.0 |
| 11 | 14.8 | 1.67 | 1.66 | 9.6 |
| 12 | 7.4 | 1.63 | | |

Again, the grit particles were separated on a Jeffrey Table. Projectability is measured using an electrostatic projectability tester which comprises two 8 inch horizontal metal plates which are positioned 0.470 inches apart, placing 50 grams of a particular shape of test grits between the two plates and applying a high voltage of 8,000 volts to the plates. A resistor is also connected to both plates and the voltage generated in the circuit across the resistor is measured, it being proportional to the plate gap current in the circuit resulting from the abrasive grit particles jumping from the bottom to the top plate. The particles on the bottom plate become charged and are attracted to the top plate. The ability of those particles to jump the gap to the top plate depends on the shape of the particles. Sharp or elongated particles can become polarized and more readily attracted to the top disc; on the other hand, blocky particles show a relatively significantly less polarization and attraction.

In Table 2 it can be seen that the particle shapes from Jeffrey Table Compartment 1 had a bulk density of 2.01 g/cc. Group 2 shapes were those extracted from Jeffrey Table Compartments 2, 3, 4 and 5, having bulk densities ranging from 1.98 to 1.96 g/cc with a weighted average bulk density of 1.97 g/cc. The third group of shapes were those extracted from Jeffrey Table compartments 6 and 7 having a bulk density ranging from 1.94 to 1.91 g/cc with a weighted average bulk density of 1.92 g/cc. The group four particles were extracted from Jeffrey Table compartments 8 and 9 with a bulk density ranging from 1.88 to 1.82 g/cc with a weighted average bulk density of 1.85 g/cc. The fifth group of particles were those extracted from Jeffrey Table compartment 10 having a bulk density of 1.78 g/cc. Finally, the sixth group of particle shapes was extracted from Jeffrey Table compartments 11 and 12 having a bulk density range of 1.63 to 1.67 g/cc with a weighted average bulk density of 1.66 g/cc. The projectability of the group six particles was 3.84 times that of the group 1 particles, indicating that there is a significantly higher projectability for sharp or elongated grit particles than there is for the blocky grit particles.

There is a disadvantage in having blocky particles included in an abrasive grit used for the manufacture of coated abrasive products. During electrostatic coating, for example, as described in U.S. Pat. No. 2,217,444, the sharp particles tend to be projected while the blocky particles tend to remain in the abrasive feed material reservoir, increasing the concentration of blocky particles in that reservoir. This phenomenon results in several problems. Firstly, the coated product being produced will not have a uniform coating weight as fewer and fewer abrasive particles of any shape are projected over time, until note is taken of the problem and the power is increased. When the power is increased, the coated product then formed has a much higher percentage of blocky particles in it, usually resulting in deficient cutting performance from the coated product. The alternative is the development of an increasing residue of blocky particles, at the end of the run, which cannot be used in coated products; this, of course, increases the cost of the finished product as a substantially higher weight of abrasive grit feed material must be used to produce a given run of coated product which is made to specification.

BRIEF SUMMARY OF THE INVENTION

The present invention comprises a method and apparatus for separating blocky and sharp abrasive grit particles of a given grit size classification from a free-falling stream of such particles by the application of electrostatic energy. The feed stream material exits a feeder which is arranged to direct the flow thereof, vertically, past a means for charging which applies a negative charge to those particles as they vertically flow by. Adjacent to, but spaced vertically apart from, the means for charging is a positively charged electrode means which extends vertically downwardly from the charging means but which, at the bottom end thereof, is preferably offset to a modest but variable degree from the vertical. The positive charge, in terms of voltage applied to the electrode means, is preferably about 2 to about 5 times, or greater, the amount of negative charge voltage applied to the charging means. For example, range of about 1,000 volts to about 5,000 volts of negative charge may be applied to the charging means while a range of about 10,000 volts to about 25,000 volts of positive charge may be applied to the electrode means. The criterion is that the amount of negative voltage which must be applied to the means for charging must be sufficiently high to create a corona effect as is well understood by those with skill in the art. The corona effect, in turn, must be sufficiently strong, in terms of voltage, to induce an electrical charge in, and polarization of, abrasive grain particles which are free-falling past, but adjacent to, the means for charging. The charge applied to the electrode means, on the other hand, must be sufficiently high in voltage to establish an opposite electrical field sufficient to attract at least the more highly charged and polarized of those abrasive particles, as they free-fall past, but adjacent to, that electrode means.

As the abrasive material of a given size classification moves past the charging means in close relationship thereto, it is subjected to the corona electrostatic energy flow surrounding the charging means and, thus, the abrasive grains, to one degree or another, become polarized, all having some inducement of a negative charge at one end and a positive charge at another end. As these polarized particles travel, by gravity flow, past the positively charged electrode means, they tend to align themselves, with the negatively charged poles generally oriented more towards the electrode means than not. Those particles which have the greatest degree of polarization, and thus the greatest electric charge, are significantly more attracted to the positively charged electrode means than those which have a lesser electric charge. Thus, the material flow is fanned out from the vertical with those particles, having the greater electric charges and the greater degree of polarization, being deflected towards the positively charged electrode to a considerably greater degree than those which have a lesser electric charge and thus a lesser degree of polarization.

As it turns out, it is the sharp grains which tend to become more polarized and thus carry a greater electric charge. The result is that the sharp grains are deflected away from the vertical free fall, while the blocky grains, having less polarization and less electric charge, tend to be deflected to a considerably lesser and more insignificant degree, if at all. In between the two, there is a mid-range where the gradient between blocky and sharp is less distinct, this mid-range containing both somewhat sharp and somewhat blocky grains. With respect to this mid-range, there is some deflection in drop-path which occurs, more than that which occurs to the distinctly blocky grains but less than that which occurs to distinctly sharp grains.

Beyond the electrode, the free fall abrasive particles, all now fanned out, are subjected to a means for physically dividing or splitting the streams into whichever number thereof are desired, those streams which had previously been segregated by electric energy. That is to say that the means for splitting, for example, can be made to create a physically separate and distinct stream of blocky particles, a physically separate and distinct stream of mid-range particles and a physically separate and distinct stream of sharp particles, i.e., three streams. Alternatively, two, four or conceivably more streams might be physically separated, if desired. The three different streams of material are then collected and used according to preference, as will be well understood by those with skill in the art.

DETAILED DESCRIPTION OF THE PREFERRED EMBODIMENT

Figure 1:
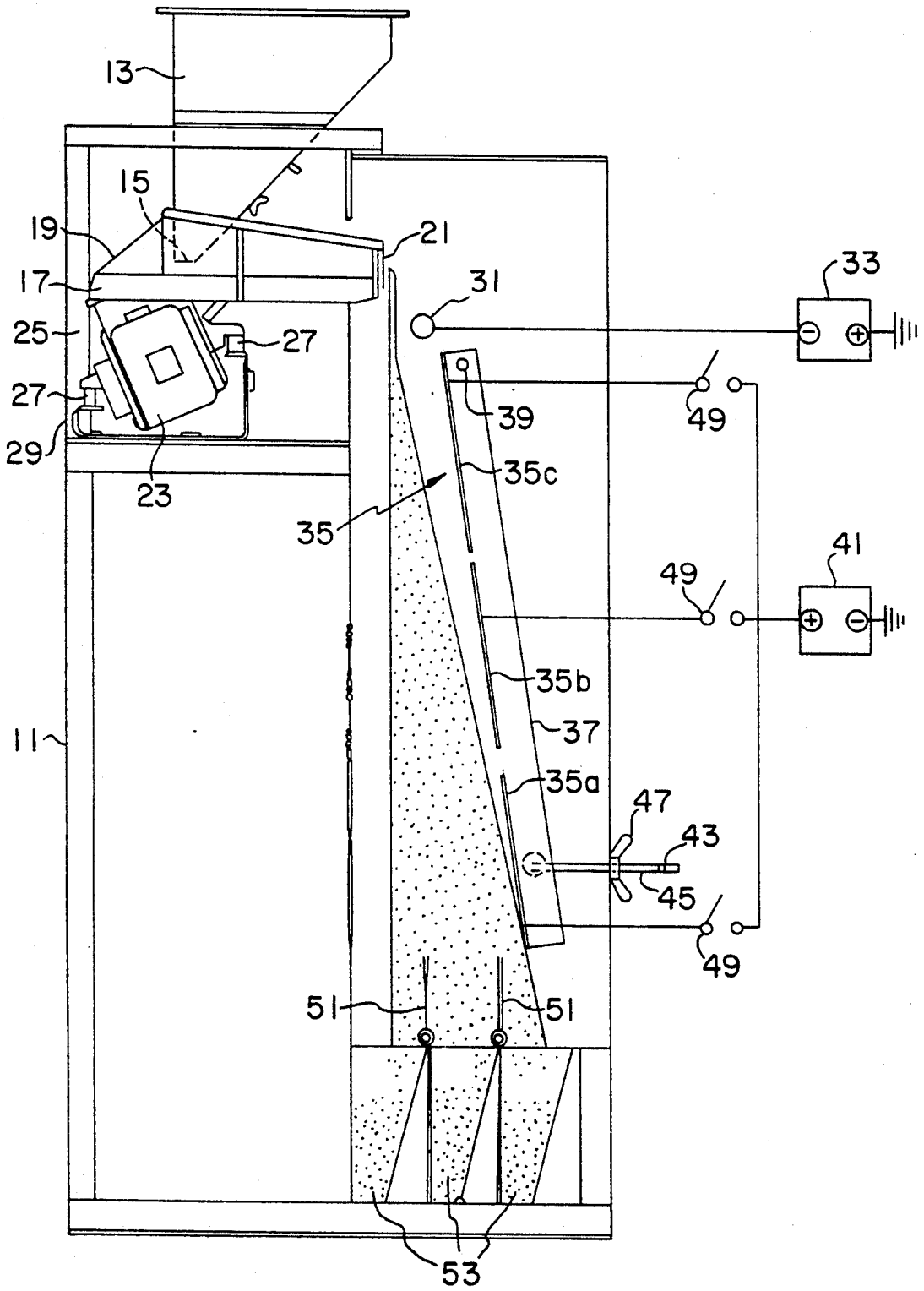
FIG. 1 is a semi-schematic side elevational View, partly cut-away, and showing the electrostatic separator of the present invention.

Referring to FIG. 1, there is shown an electrostatic source according to the preferred embodiment of the present invention. Support frame 11 has mounted thereto feedhopper 13 which is open at the bottom 15 to provide a continuous flow of any common given size classification of abrasive grain onto vibration platform 17. Vibration platform 17 has a shroud 19 mounted thereto in a position to at least partially surround vibration platform 17. Shroud 19 is open on one end 21 such that when vibration platform 17 is vibrated, particulate material thereon will fall off of it at a point adjacent to the shroud 19 open end 21. Vibrating platform 17 is operated by a magnetic drive 23 which transmits vibrations to the platform 17 through arm 25 (there may be multiples of arm 25). Magnetic drive 23 in turn is mounted on shock absorbers 27 to dampen the vibration caused by the action of magnetic drive 23. The shock absorbers 27 in turn are mounted on base 29 which is mounted to frame 11. As vibratory platform 17 is vibrated, the particular size classification of abrasive grain being used flows from hopper 13 through feed hopper bottom 15 onto vibratory platform 17 which in turn vibrates it to move it towards the open end 21 of shroud 19, thus spilling the abrasive grain material over the unshrouded edge of vibratory platform 17.

The abrasive grain material then is in a free-fall state wherein it falls, by gravity, adjacent to charger bar 31, those grain particles falling in close relation to charger bar 31, but not necessarily in physical contact with charger bar 31. Charger bar 31 preferably has negative charge, in the range of about 1,000 volts to about 5,000 volts, applied to it by power source 33, although the voltage could be higher. In fact, it is preferred that the grain particles do not come into contact with charger bar 31. Therefore, charger bar 31 is horizontally off-set to some degree from the free-fall drop-path of the abrasive grain material as is shown in FIG. 1. As the abrasive grain material flows downwardly past charger bar 31, the electric energy contained in the corona effect of the high voltage charge, imposed by power source 33 on charger bar 31, tends to charge and polarize, by induction, the nearby particles of abrasive grain as they flow past, thus, imparting electric energy to those particles.

Those particles which have been induced with the highest amount of electric energy are those that are most polarized, those being the ones with the highest aspect ratio. In other words, it is the sharp grains or elongated grains which are the most highly polarized. On the other hand, the grains which accept the least amount of electric energy and have the least amount of polarization induced thereto are those which have the lowest aspect ratio. Thus, it is the blocky grains which carry the least amount of electric energy and have the least amount of polarization induced thereto.

As the variously charged and polarized particles of abrasive grain descend further, in a vertical direction, they free-fall in close relationship to generally vertically disposed plate 35 which is fixed to support bracket 37 which, in turn, is pivotally mounted on pin 39. Plate 35 may, optionally, be divided into electrically discontinuous segments 35*a*, 35*b* and 35*c*. Plate 35 is connected to power source 41 which delivers a positive charge, preferably in the range of about 10,000 volts to about 25,000 volts, to plate 35, although the voltage could be higher. Angle adjuster 43 is attached to the lower section of support bracket 7 and functions to adjust the pivoting, about pin 39, of support bracket 37 with plate 35 mounted thereto. The pivoting may be away from an otherwise vertical orientation such that the lower section of plate 35 may be adjusted away from or towards the stream of abrasive grain particles which are free falling from vibratory platform 17, as described above. The purpose of such adjustment is to optimize the fanning out of the free-fall grain, and to compensate for different predominant shape compositions of various grit batches and different grit sizes.

As shown in FIG. 1, angle adjuster 43 is comprised of threaded rod 45 which is the portion of angle adjuster 43 which is actually connected to support bracket 37, and threaded handle 47, which by being adjusted in one direction or the other on threaded rod 45, serves to adjust the angle of plate 35 and support bracket 37, away from or toward the falling abrasive particles. Optionally, the length of positive electrode plate 35, as well as the location of the corona of electric energy emanating from plate 35, can be controlled by opening and closing switches 49, thus directing current flow to plate segments 35*a*, 35*b*, 35*c*.

The stream of abrasive grain material is electrically charged and polarized, each particle to one degree or another. Those particles which have the greatest amount of polarization are attracted to the positive charge of plate 35, thus the otherwise vertical free fall of those particles is deflected towards plate 35 while particles with lesser degrees of electric charge and less polarization are not attracted nearly as much; those which have very little electric charge and little polarization are not attracted to any significant degree, and thus they are not diverted to any significant degree from their original vertical path of travel. The sharp or elongated particles are those which tend to have the highest amount of charge and they, correspondingly, tend to be deflected the most towards plate 35. The blocky particles tend to have the least amount of electric energy and the least amount of polarization and thus they are the particles which tend to be deflected the least, mostly to no significant degree, predominantly falling vertically downward from vibratory platform 17. Those particles which are in a mid-range, not being either distinctly blocky or sharp in character, for example, those particles having an aspect ratio of between about 2:1 and 3:1, are deflected somewhat, but not to the same degree that the sharp, elongated particles are deflected. The stream of abrasive grain material spreads out in more or less of a uniform fan shape adjacent to the lower extremity of plate 35, about as shown in FIG. 1, to be divided into, for example, three "shape segregations" of particles, those being the blocky segregation, the sharp segregation, and in between, the mid-segregation. Of course, the resultant number of segregations depends on the shape composition and make-up of the particular batch of abrasive grit material being separated. The different shape segregations are not, at this point, physical separations, but rather are merely predominations of different shapes in respectively different locations through the fanned out cross section of the stream of abrasive grain material.

As the shape segregated particles, as yet not distinctly and physically separate streams, fall past the lower extremity of plate 35, they are engaged by splitters 51 which are in the form of upward projecting plates pivotally mounted for adjustment purposes. The splitters 51 physically separate the shape segregated particles into, for example, three different streams of particles and divert each to separate containers. The midstream, which is collected as a distinct stream, may be reintroduced to the system and subjected to the same electrostatic separation again, but in this case possibly using only a single splitter to create two different streams. After being split and physically separated, the different streams are collected as, for example, in compartments 53, or in any other appropriate container as will be understood by those with skill in the art.

Table 3 lists the specified bulk density ranges for various brown alumina abrasive grit sizes. The designations of the specific products listed are C-31 and C-31M (modified C-31) for two different grades of sharp grinding wheel grit, C-32 for blocky grinding wheel grit and G-52E for coated abrasive product grit for paper or cloth backings.

TABLE 3

| Grit Size | C-31 | C-31M | C-32 | G-52E |
|---|---|---|---|---|
| 12 | 1.89–1.99 | — | 2.00–2.07 | — |
| 16 | 1.86–1.94 | — | 1.97–2.04 | 1.85–1.93 |
| 24 | 1.76–1.82 | — | 1.92–1.99 | 1.79–1.88 |
| 36 | 1.70–1.76 | 1.74–1.84 | 1.85–1.92 | 1.73–1.82 |
| 90 | 1.64–1.70 | 1.66–1.78 | 1.80–1.87 | 1.65–1.75 |
| 100 | 1.63–1.67 | 1.59–1.69 | 1.71–1.78 | 1.66–1.74 |
| 150 | — | 1.57–1.67 | 1.68–1.75 | 1.62–1.72 |

Figure 2:
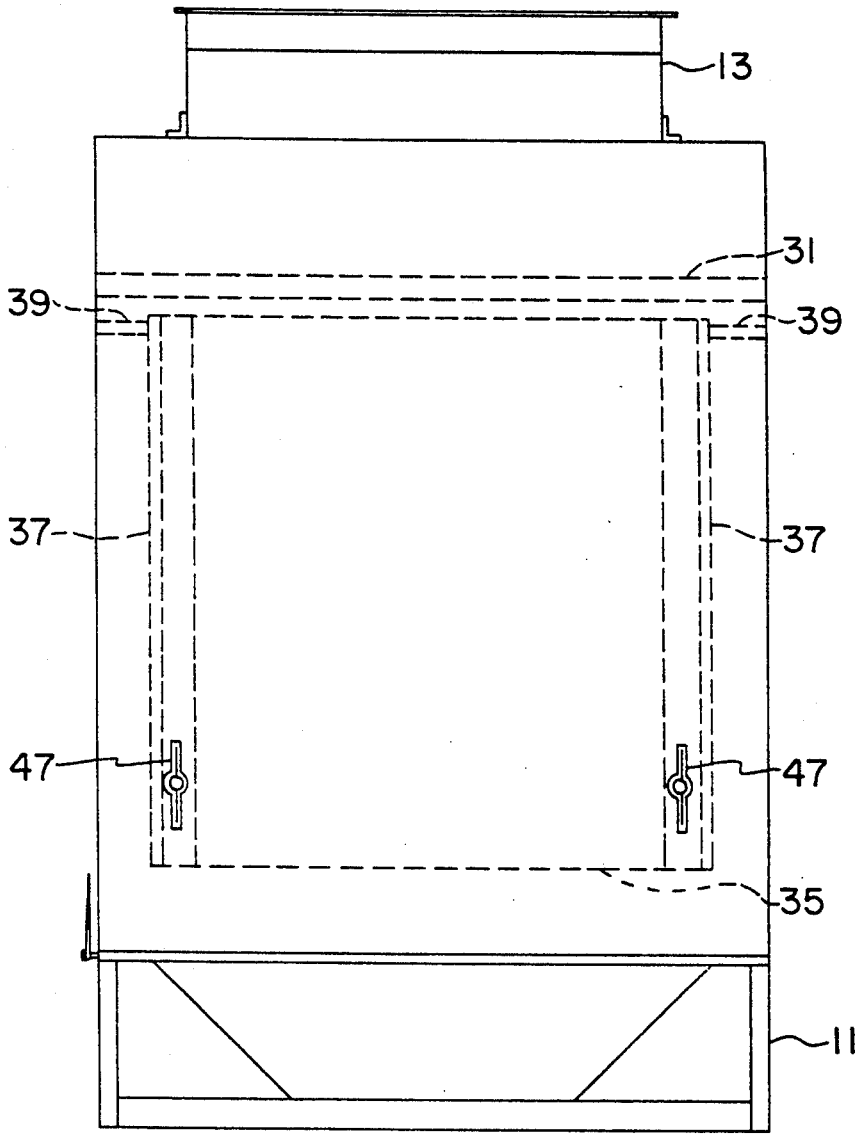
FIG. 2 is a front elevational view of the electrostatic separator of the present invention showing in outline form some of the significant internal elements.

A separator, in accord with the preferred embodiment of the present invention, as shown in FIGS. 1 and 2 and described above in relation thereto, was constructed to conduct laboratory testing. This laboratory separator comprised a 2" wide vibratory feeder, a 9" long charging bar (negative charge) and a 9" wide positive charge electrode approximately 30" long and inclined, from top to bottom, away from the falling abrasive stream.

EXAMPLE I

In Example I, a 16 grit size brown alumina feed material, having a bulk density of 1.98 g/cc was fed, at a feed rate of 70 lbs. per inch per hour (70 lbs./inch/hour) into the laboratory separator described above and separated into 2, 3 and 4 streams as follows:

| | Bulk Density-g/cc-Example I | | | | Bulk Density Spread |
|---|---|---|---|---|---|
| | Stream 1 | Stream 2 | Stream 3 | Stream 4 | g/cc |
| 2 Stream Separation | 2.00 | 1.97 | — | — | .03 |
| 3 Stream Separation | 2.01 | 1.99 | 1.95 | — | .06 |
| 4 Stream Separation | 2.00 | 2.00 | 1.98 | 1.94 | .06 |

EXAMPLE II

Example II was a 24 grit size brown alumina feed material, having a bulk density of 1.88 g/cc and it was fed at a feed rate of 60 lbs./inch/hour into the laboratory separator described above and separated into 2, 3 and 4 streams as follows:

| | Bulk Density-g/cc-Example II | | | | Bulk Density Spread |
|---|---|---|---|---|---|
| | Stream 1 | Stream 2 | Stream 3 | Stream 4 | g/cc |
| 2 Stream Separation | 1.91 | 1.86 | — | — | .05 |
| 3 Stream Separation | 1.92 | 1.90 | 1.83 | — | .09 |
| 4 Stream Separation | 1.92 | 1.90 | 1.88 | 1.80 | .12 |

EXAMPLE III

Example III a 36 grit size brown alumina feed material, having a bulk density of 1.81 g/cc, was fed at a feed rate of 50 lbs./inch/hour into the laboratory separator described above and separated into 2, 3 and 4 streams as follows:

| | Bulk Density-g/cc-Example III | | | | Bulk Density Spread |
|---|---|---|---|---|---|
| | Stream 1 | Stream 2 | Stream 3 | Stream 4 | g/cc |
| 2 Stream Separation | 1.85 | 1.76 | — | — | .09 |
| 3 Stream Separation | 1.86 | 1.82 | 1.76 | — | .11 |
| 4 Stream Separation | 1.85 | 1.84 | 1.80 | 1.70 | .15 |

EXAMPLE IV

Example IV was a 60 grit size brown alumina feed material, having a bulk density of 1.73 which was fed at a rate of 30 lbs./inch/hour into the laboratory separator described above and split into 2, 3 and 4 stream as follows:

| | Bulk Density-g/cc-Example IV | | | | Bulk Density Spread |
|---|---|---|---|---|---|
| | Stream 1 | Stream 2 | Stream 3 | Stream 4 | g/cc |
| 2 Stream Separation | 1.77 | 1.69 | — | — | .08 |
| 3 Stream Separation | 1.80 | 1.75 | 1.63 | — | .17 |
| 4 Stream Separation | 1.81 | 1.79 | 1.74 | 1.61 | .20 |

EXAMPLE V

In Example V a 100 grit size brown alumina feed material, having a bulk density of 1.67 g/cc, was fed at a feed rate of 12 lbs./inch/hour into the laboratory separator described above and separator into 2, 3 and 4 streams as follows:

| | Bulk Density-g/cc-Example V | | | | Bulk Density Spread |
|---|---|---|---|---|---|
| | Stream 1 | Stream 2 | Stream 3 | Stream 4 | g/cc |
| 2 Stream Separation | 1.74 | 1.62 | — | — | .12 |
| 3 Stream Separation | 1.74 | 1.72 | 1.63 | — | .11 |
| 4 Stream Separation | 1.76 | 1.75 | 1.71 | 1.57 | .19 |

EXAMPLE VI

Example VI was a 150 grit size brown alumina feed material, having a bulk density of 1.67 g/cc, which was fed at a rate of 10 lbs./inch/hour into the laboratory separator described above and split into 2, 3 and 4 streams as follows:

| | Bulk Density-g/cc-Example VI | | | | Bulk Density Spread |
|---|---|---|---|---|---|
| | Stream 1 | Stream 2 | Stream 3 | Stream 4 | g/cc |
| 2 Stream Separation | 1.71 | 1.66 | — | — | .05 |
| 3 Stream Separation | 1.71 | 1.70 | 1.63 | — | .08 |
| 4 Stream Separation | 1.71 | 1.71 | 1.68 | 1.60 | .11 |

From comparing Examples I–VI, an indication can be discerned that the coarser grit feed materials are less readily separated. This is believed to result from the fact that the coarser grit feed materials have a lower surface area to mass ratio. The available surface area is directly proportional to the degree of charge which can be accepted by the particles of material. In addition, the more mass each individual particle has, the more energy is required to divert it from a vertical, gravity-induced fall, to impart a horizontal component to that gravity induced fall. The 60 grit size and 100 grit size materials, of Examples IV and V, respectively, achieved the greatest values of bulk density spread and, thus, the greatest degree of separation, in comparison with the other foregoing examples. The finest material, 150 grit size, of Example VI had a lower degree of separation than those of Examples IV and V (60 grit size and 100 grit size). This is believed to be caused by air turbulence having a relatively greater affect on high surface area-to-mass particles which do not have a particularly streamlined shape. In addition, due to the limited size and free fall distance of the laboratory separator described above, the sharper particles of finer grit size may not complete their horizontal migration during the short free fall; this problem can readily be corrected on scale-up of the laboratory size to a production size. Another phenomena that may have affected separation is excessive feed rate; basically there can be just too many particles; thus, the sharper particles are blocked, physically, from migrating toward the positively charged electrode.

EXAMPLE VII

The previous examples illustrate the shape separation of a single specific grit size of feed material. There may be, however, a processing advantage, in a specific abrasive crushing plant, to separating splits, by shape, before the final grading into specific grit sizes. The grading size of a single specific sized, shape-separated grit may change slightly; the blocky fraction may become slightly coarser and the sharp fraction may become slightly finer. If the single specific grit sized feed material is close to the grading size limits, regrading may be required after separation. On the other hand, if a split is first shape-separated and then specific size graded, regrading can be eliminated.

In Example VII, a 24/36 split of brown alumina feed material, containing 24, 30 and 36 grit size particles was shape separated into 2 and 4 streams. Two specific grit sizes of material, 24 and 36, were graded from both of the 2 shape-separated streams and from the most blocky and the sharpest (highest and lowest bulk density) streams of the 4 stream shape separation. Separately and for comparison, a portion of the split was size graded without shape separation and the 24 and 36 grit size materials, respectively, had bulk densities of 1.88 g/cc and 1.81 g/cc. The results of determining the respective bulk densities of the foregoing shape separated and subsequently size graded streams is as follows:

| | Bulk Density-g/cc-Example VII | | Bulk Density Spread |
|---|---|---|---|
| | Stream 1 | Stream 2 | g/cc |
| 24 grit | | | |
| 2 Stream Separation | 1.92 | 1.83 | .09 |
| 4 Stream Separation | 1.94 | 1.78 | .16 |
| 36 grit | | | |
| 2 Stream Separation | 1.85 | 1.78 | .07 |
| 4 Stream Separation | 1.88 | 1.74 | .14 |

The bulk density spread of the 24 and 36 grit sized material, which was first shape separated and then sized graded for this Example VII were equivalent to or slightly greater than the Bulk Density Spread of the 24 and 36 grit size materials of Examples II and III, respectively.

Tests have indicated that using a negative charge, on the charger bar 31, in a range of about 1,000 volts to about 5,000 volts and using a positive charge in a range of about 10,000 volts to about 25,000 volts on the plate 35 will result in separation of particles at least into two streams, one being predominantly sharp and the other being predominantly blocky, within about 1 to 2 feet of the upper-most edge of the plate 35. A 36 grit feed material was tested in this system having a 1.81 g/cc bulk density, and it was separated into two distinct streams, the sharp stream having a bulk density of 1.76 g/cc and the blocky stream having a bulk density of 1.85 g/cc as shown in Example III. In another test, a 36 grit feed material was used and divided into three streams which were captured showing a bulk density for the sharp material of 1.76 g/cc and a bulk density for the blocky material of 1.86 g/cc with a bulk density of 1.82 g/cc for mid-range material also as shown in Example III. The 1.76 g/cc bulk density sharp material, collected as above, was subjected to a second stage separation, with a separation into two streams, one showing a bulk density of 1.71 g/cc and the other having a bulk density of 1.81 g/cc. The 1.85 g/cc bulk density stream, from above, was subjected to a second stage separation and split into two streams, with bulk densities of 1.82 g/cc and 1.88 g/cc. Thus, as can be noted, the control of bulk densities and, thus, the degree of blockiness and/or sharpness of the streams of materials collected, can be imposed to a very refined degree.

The same laboratory separator described above, just preceding Example I, was also used to conduct testing in regard to separating shapes on a two-stage basis. In the first stage separation, the material was split into 2 streams, 3 streams and 4 streams. From the 2 stream separation, each collected stream was subjected to a second stage separation into 2 second stage streams. From the 3 stream separation, each collected stream was subjected to a second stage separation into 3 second stage streams. The bulk density spread, the difference in g/cc, between the highest bulk density and the lowest bulk density measured for each respective stage of separation is recorded in Table 4 below:

TABLE 4

| Grit Size | Feed Rate lbs/in/hr. | Bulk Density Spread - g/cc 2 stream | 3 stream | 4 stream |
|---|---|---|---|---|
| | | | Stage 1 | |
| 12 | 80 | .03 | .05 | .06 |
| | | | Stage 2 | |
| | 80 | .08 | .11 | |
| | | | Stage 1 | |
| 16 | 70 | .03 | .06 | .06 |
| | | | Stage 2 | |
| | 70 | .08 | .11 | |
| | | | Stage 1 | |
| 24 | 60 | .05 | .09 | .12 |
| | | | Stage 2 | |
| | 60 | .12 | .17 | |
| | | | Stage 1 | |
| 36 | 50 | .09 | .11 | .15 |
| | | | Stage 2 | |
| | 50 | .17 | .22 | |
| | | | Stage 1 | |
| 60 | 30 (50) | .08 | .17 | .20 (.08) |
| | | | Stage 2 | |
| | 30 | .16 | .31 | |
| | | | Stage 1 | |
| 100 | 12 | .12 | .11 | .19 |
| | | | Stage 2 | |
| | 12 | .21 | .28 | |
| | | | Stage 1 | |
| 150 | 10 | .05 | .08 | .11 |
| | | | Stage 2 | |

TABLE 4-continued

| Grit Size | Feed Rate lbs/in/hr. | Bulk Density Spread - g/cc 2 stream | 3 stream | 4 stream |
|---|---|---|---|---|
| | 10 | .10 | .14 | |

It will be noted from Table 4, above, that generally, the two-stage separation produces a significantly greater bulk density spread than the single-stage separation. Note that a variation was tried with the 60 grit material, i.e., speeding up the material feed rate. The bulk density spread corresponding to the speeded up feed rate, as well as that corresponding speeded up feed rate, are shown in parenthesis. It will also be noted that feed rates necessarily decrease as grit size decreases. Grit size 150, a relatively fine grit, can only be fed at 10 lbs./inch/hour to a preferred degree of bulk density difference for the shape separation of that size of grit. On the other hand, the feed rate for grit size 12, the largest grit size tested, is 80 lbs./inch/hour to achieve a preferred degree of bulk density difference for the shape separation of that size of grit.

It will be apparent to those skilled in the art that various modifications and variations could be made to the present invention, as described, within the scope of the principles thereof. The scope and breadth of the present invention, therefore, is not limited by the foregoing which is a statement of the best mode as is required by the U.S. Patent Laws. The following claims, however, are the definition of the present invention and the scope and breadth thereof.

What is claimed is:

1. An abrasive grain shape separator comprising:

a) a support frame means;

b) a feed hopper means, mounted to said support frame means, generally at the highest elevation thereof;

c) a feeder means, disposed vertically beneath said feed hopper means, said feeder means which is operably mounted to said support frame means to generally horizontally move abrasive grains disposed thereon from said feed hopper means;

d) shroud means, mounted to said feeder means, disposed to prohibit the movement of said abrasive grains, caused by operation of said feeder means, from said feeder means except over a single portion thereof;

e) means for charging operable to induce, by negative corona charge, an electric charge and polarization to said abrasive grains as said abrasive grains free-fall vertically past said means for charging, in adjacent proximity thereto, said means for charging which is disposed at a lower elevation than, but in close proximity to, said single portion of said vibratory feeder means, said means for charging which is mounted to said support frame means;

f) electrode means, disposed generally vertically downwardly from, but spaced apart from, said means for charging, said electrode means which are operable to induce, by creation of a positive electrical field, an attraction to said electrically polarized and charged abrasive grains which free-fall vertically past said electrode means after free-falling past said means for charging, and being thereby electrically polarized and charged thereby, said positive electrical field which is sufficiently strong to divert at least some of said electrically polarized and charged abrasive grains from a vertical free-fall; said electrode means which is adjustably mounted to said support frame means;

g) means for adjusting said electrode means, operable to adjust at least a portion of said electrode means closer to or further away from said free-fall of said electrically polarized and charged abrasive particles; and h) means for splitting said free-falling electrically charged and polarized abrasive grains, which have been diverted to one degree or another as well as those which are not significantly diverted, into physically separate streams.

2. The invention of claim 1 wherein said feeder means comprises a vibratory feeder.

3. The invention of claim 1 wherein said single portion of said feeder means comprises a single edge.

4. The invention of claim 1 wherein said means for charging comprises a charger bar.

5. The invention of claim 1 wherein said electrode means comprises a generally vertically disposed electrode plate.

6. The invention of claim 1 wherein said means for adjusting comprises the combination of:

a) at least one threaded rod;

b) at least one threaded handle engaged with each of said at least one threaded rod which functions by rotation to longitudinally move said at least one threaded rod therethrough, said at least one threaded handle which is rotably mounted to said support frame means; and c) support bracket means, movably mounted to said support frame means, engaged with said electrode means and to which one end of said at least one threaded rod is mounted;

said combination which functions such that rotation of each of said at least one threaded handle causes longitudinal movement therethrough of that said at least one threaded rod with which said at least one threaded handle is engaged, said longitudinal movement of said at least one threaded rod which results in movement of the position of said electrode means.

7. The invention of claim 1 further comprising electrical power source means which functions to deliver high voltage electrical energy to said means for charging and said electrode means.

8. The invention of claim 1 further comprising means to localize said positive electrical field to differing portions of said electrode means.

9. The invention of claim 1 wherein said means for splitting comprises at least one generally vertically upwardly projecting plate, positioned elevationally lower than the lowest extremity of said electrode means, said at least one generally vertically upwardly projecting plate which is disposed in the drop-path of travel of said free-falling electrically charged and polarized abrasive grains, including both those which have been diverted and those which are not significantly diverted, said at least one generally vertically upwardly projecting plate which is pivotally mounted, at about its lowermost portion, to said support frame means.

10. The invention of claim 1 further comprising means for collection which function to separately collect each of said physically separate streams.

11. The invention of claim 1 wherein said means for charging comprises a charger bar and said electrode means comprises a generally vertically disposed electrode plate.

12. The invention of claim 7 wherein said means for charging comprises a charger bar and said electrode means comprises a generally vertically disposed electrode plate.

13. The invention of claim 12 further comprising means to localize said positive electrical field to differing portions of said electrode means.

14. The invention of claim 13 wherein said means to localize comprises a plurality of electrical switches wired in parallel circuit between said electrical power source means and said generally vertically disposed electrode plate.

15. The invention of claim 14 wherein said means for adjusting comprises the combination of:

a) at least one threaded rod;

b) at least one threaded handle engaged with each of said at least one threaded rod which functions by rotation to longitudinally move said at least one threaded handle which is rotably mounted to said support frame means; and c) support bracket means, pivotally mounted to said support frame means and mounted to said electrode plate, to which one end of said at least one threaded rod is mounted;

said combination which functions such that rotation of each of said at least one threaded handle causes longitudinal movement therethrough of that said at least one threaded rod with which said at least one threaded handle is engaged, said longitudinal movement of said at least one threaded rod which results in pivotal movement of position of said electrode plate.

16. The invention of claim 15 wherein said feeder means comprises a vibratory feeder.

17. The invention of claim 16 wherein said means for splitting comprises at least one generally vertically upwardly projecting plate, positioned elevationally lower than the lowest extremity of said electrode plate, said at least one generally vertically upwardly projecting plate which is disposed in the drop-path of travel of said free-falling electrically charged and polarized abrasive grains, including both those which have been diverted and those which are not significantly diverted, said at least one generally vertically upwardly projecting plate which is pivotally mounted, at about its lowermost position, to said support frame means.

18. The invention of claim 17 further comprising means for collection which function to separately collect each of said physically separate streams.

19. A method of separating abrasive grain shapes, by shape classification, comprising:

a) free-falling abrasive grain particles, by gravity, vertically past means for inducing, by negative corona charge, an electric charge and polarization of one degree or another in respect to substantially each of said abrasive grain particles;

b) inducing, by negative corona charge, an electric charge and polarization of one degree or another in respect to substantially each of said abrasive grain particles, as said abrasive grain particles are free-falling, by gravity, vertically past said means for inducing;

c) free-falling said electrically charged and polarized abrasive grains vertically past electrode means, which are operable, by creation of a positive electrical field, to divert at least some of said electrically charged and polarized abrasive grains from a vertical free-fall;

d) diverting at least some of said electrically charged and polarized abrasive grains from a vertical free-fall by attraction of said abrasive grains to a positive pole of the electrical field;

e) physically splitting said at least some of said electrically charged and polarized abrasive grains into separate shape classifications which include, but are not limited to, blocky grains and sharp grains; and f) separately collecting said blocky grains and said sharp grains.

20. An abrasive grain shape separator comprising:

a) means for inducing, by negative corona charge, and electrical charge and polarization of one degree or another in respect to each of abrasive grain particles as said abrasive grain particles are free-falling by gravity vertically past said means for inducing;

b) electrode means, operable by creation of a positive electrical field, for diverting at least some of said electrically charged and polarized abrasive grain particles from said vertical free-fall;

c) means for causing the free-fall of abrasive grain particles, by gravity, vertically past said means for inducing, and then vertically past said electrode means;

d) means for physically splitting said at least some of said electrically charged and polarized abrasive grain particles into separate shape classifications which include, but are not limited to, blocky and sharp grains; and e) means for separately collecting said blocky grains and said sharp grains.

* * * * *